US009010440B2

(12) United States Patent
Rodger et al.

(10) Patent No.: US 9,010,440 B2
(45) Date of Patent: Apr. 21, 2015

(54) METHOD AND APPARATUS FOR CENTRIFUGAL SEPARATION

(75) Inventors: George Joel Rodger, Houston, TX (US); Denman L. Cloudt, Jr., Barksdale, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 1389 days.

(21) Appl. No.: 12/369,043

(22) Filed: Feb. 11, 2009

(65) Prior Publication Data

US 2010/0200242 A1 Aug. 12, 2010

(51) Int. Cl.

| | |
|---|---|
| ***B04B 15/00*** | (2006.01) |
| ***B04B 15/08*** | (2006.01) |
| ***E21B 47/00*** | (2012.01) |
| ***E21B 7/00*** | (2006.01) |
| ***E21B 43/34*** | (2006.01) |

(52) U.S. Cl.

CPC ..... *E21B 43/34* (2013.01)

(58) Field of Classification Search

USPC ..... 166/369, 357, 264, 265; 494/39, 10; 175/66, 69; 210/170.11, 512.1

See application file for complete search history.

(56) References Cited

U.S. PATENT DOCUMENTS

| | | | | |
|---|---|---|---|---|
| 3,516,490 | A | 6/1970 | Smalling | |
| 4,376,676 | A | 3/1983 | Gill | |
| 4,617,030 | A | 10/1986 | Heath | |
| 5,431,228 | A | 7/1995 | Weingarten | |
| 5,570,744 | A * | 11/1996 | Weingarten et al. | 166/357 |
| 5,698,014 | A | 12/1997 | Cadle | |
| 6,296,060 | B1 * | 10/2001 | McCaslin | 166/357 |
| 6,328,118 | B1 * | 12/2001 | Karigan et al. | 175/66 |
| 6,962,199 | B1 * | 11/2005 | Tjeenk Willink | 166/265 |
| 7,575,672 | B1 * | 8/2009 | Gilmore | 210/117 |
| 2004/0011745 | A1 * | 1/2004 | Oserod | 210/718 |
| 2005/0173337 | A1 | 8/2005 | Costinel | |
| 2005/0269134 | A1 | 12/2005 | Strazhgorodskiy | |
| 2008/0060846 | A1 | 3/2008 | Belcher | |
| 2009/0211764 | A1 * | 8/2009 | Fielding et al. | 166/357 |
| 2010/0147591 | A1 * | 6/2010 | Pomerleau et al. | 175/61 |
| 2010/0218944 | A1 * | 9/2010 | Quigley et al. | 166/265 |

FOREIGN PATENT DOCUMENTS

| | | |
|---|---|---|
| CA | 2630022 | 8/2003 |

OTHER PUBLICATIONS

Office Action for Canadian Patent Application No. 2,691,918 dated Nov. 7, 2011.

Extended Search Report and Opinion for European Application No. 10250231.7 dated Dec. 7, 2011.

* cited by examiner

*Primary Examiner* — James G Sayre

(74) *Attorney, Agent, or Firm* — Patterson & Sheridan, LLP

(57) ABSTRACT

Embodiments of the present invention generally relate to methods and apparatus for centrifugal separation. In one embodiment, a separator includes an outer tubular having ends sealed from the environment and an inner tubular. The inner tubular is disposed within the outer tubular, has ends in fluid communication with a bore of the outer tubular, and is attached to the outer tubular. The separator further includes an inlet. The inlet is disposed through a wall of the outer tubular, in fluid communication with a bore of the inner tubular, and tangentially attached to the inner tubular so that fluid flow from the inlet to the inner tubular is centrifugally accelerated. The separator further includes a gas outlet in fluid communication with the outer tubular bore; and a liquid outlet in fluid communication with the outer tubular bore.

32 Claims, 12 Drawing Sheets

METHOD AND APPARATUS FOR CENTRIFUGAL SEPARATION

BACKGROUND OF THE INVENTION

1. Field of the Invention

Embodiments of the present invention generally relate to methods and apparatus for centrifugal separation.

2. Description of the Related Art

After a wellbore through a hydrocarbon-bearing formation, i.e., crude oil and/or natural gas, has been drilled and completed, a potential test may be performed. The potential test determines the maximum crude oil and/or natural gas that may be produced from the wellbore in a short period of time, such as twenty-four hours. The potential test may also be run periodically during the production life of the wellbore. The production stream from the wellbore may include natural gas, free water, and crude oil (which may include water emulsified therein). The conventional approach to potential testing a wellbore is to use a separator to separate the multi-phase production stream into distinctive liquid and gas or crude oil, free water, and gas phases. Separate flow meters may then measure the respective flow rates of the separated phases. A single test unit including the separator and flow meters may be used to test a group of wellbores. Each individual wellbore is tested and then the test unit is moved to the next wellbore and so on. These separators are relatively large in physical size and expensive to construct. Therefore, there is a need in the art for a more economical and compact separator for production testing.

SUMMARY OF THE INVENTION

Embodiments of the present invention generally relate to methods and apparatus for centrifugal separation. In one embodiment, a separator includes an outer tubular having ends sealed from the environment and an inner tubular. The inner tubular is disposed within the outer tubular, has ends in fluid communication with a bore of the outer tubular, and is attached to the outer tubular. The separator further includes an inlet. The inlet is disposed through a wall of the outer tubular, in fluid communication with a bore of the inner tubular, and tangentially attached to the inner tubular so that fluid flow from the inlet to the inner tubular is centrifugally accelerated. The separator further includes a gas outlet in fluid communication with the outer tubular bore; and a liquid outlet in fluid communication with the outer tubular bore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
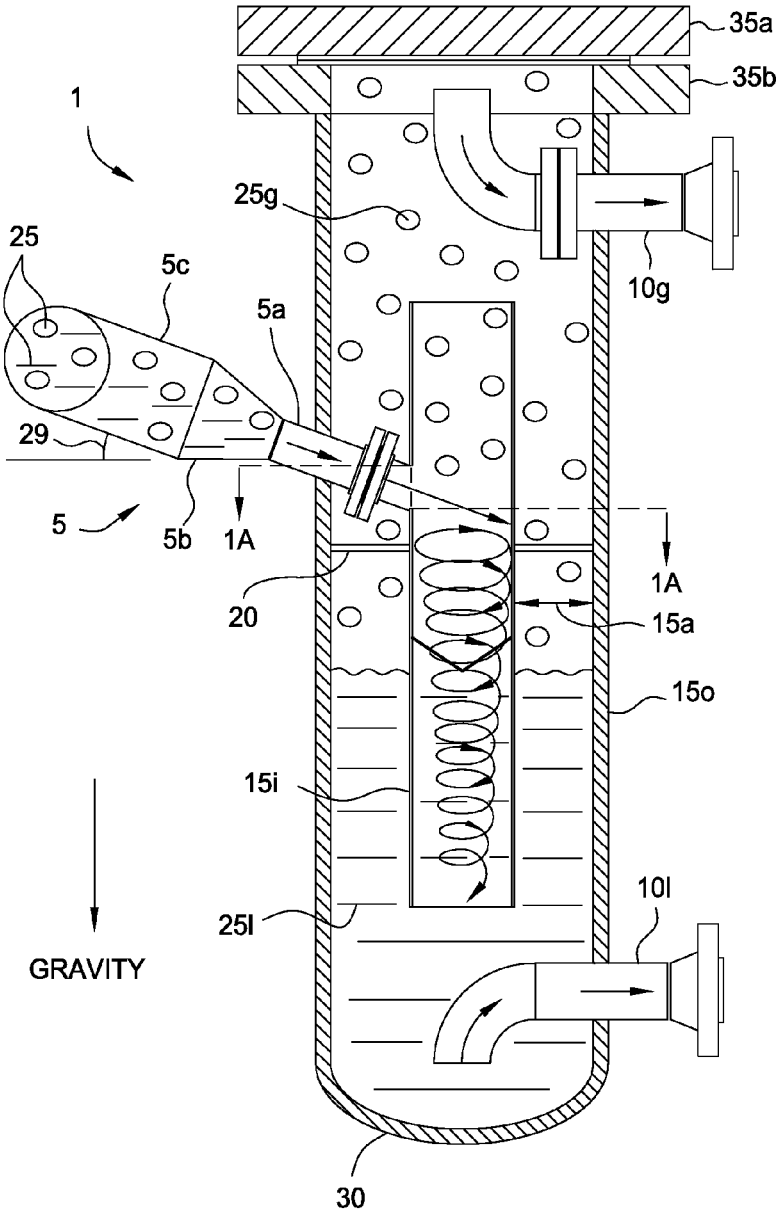
FIG. 1 is a cross-section of a centrifugal separator, according to one embodiment of the present invention.
Figure 1A:
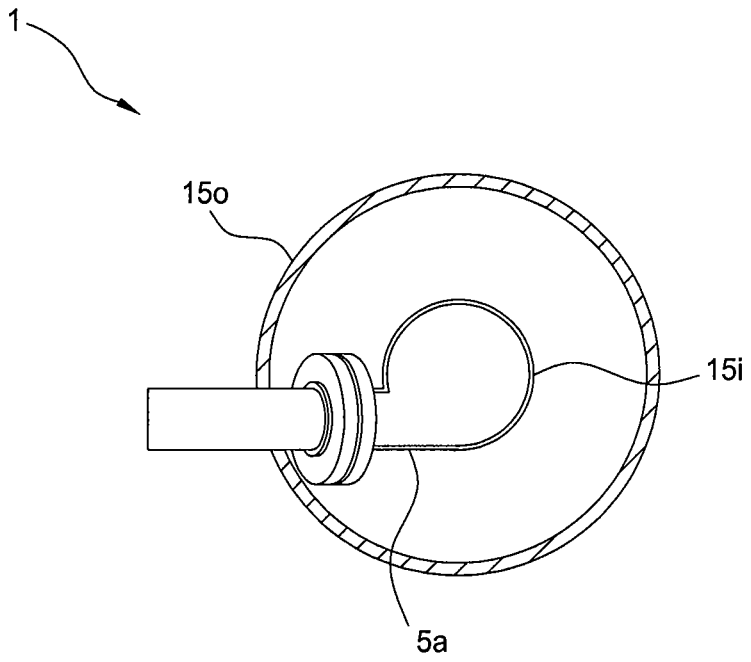
FIG. 1A is a cross-section taken along the line 1A-1A of FIG. 1.

FIG. 1 is a cross-section of a centrifugal separator 1, according to one embodiment of the present invention. FIG. 1A is a cross-section taken along the line 1A-1A of FIG. 1. The separator 1 may include an inlet 5, a gas outlet 10*g*, a liquid outlet 10*l*, an outer tubular 15*o*, an inner tubular 15*i*, a support 20, and longitudinal caps 30, 35*a, b*. The separator 1 may be made from a metal or alloy, such as low carbon steel, stainless steel, or specialty corrosion resistant alloys depending on fluid service. The outer tubular 15*o* may have a central longitudinal bore formed therethrough. The tubulars 15*i, o* may lie in a vertical orientation such that longitudinal axes thereof are parallel to gravity. The outer tubular bore may be sealed at a first longitudinal end by the cap 35*a, b*. The cap 35*a, b* may include a flange 35*a* attached to the outer tubular 15*o*, such as by welding and a blind flange 35*b* fastened to the flange 35*a* with threaded fasteners, such as bolts or studs. The bore may be sealed at a second longitudinal end by the cap 30. The cap 30 may be hemispherical or hemi-ellipsoidal and attached to the outer tubular, such as by welding. Either or both of caps 30, 35*a, b* may include the flanges or the welded fitting.

Production fluid 25 may enter the separator 1 from an external source connected to the inlet 5. The inlet 5 may be horizontal, inclined relative to a horizontal axis by an angle 29, or include a horizontal portion and an inclined portion. The angle 29 may be substantially less than ninety degrees, such as ten to forty-five degrees. The inlet 5 may include a first tubular portion 5*a* having a first diameter, a nozzle 5*b*, a second tubular portion 5*c* having a second diameter, and a third portion 5*d* (see FIG. 3) having the second diameter. The first inlet portion 5*a* may extend through an opening formed through a wall of the outer tubular and an annulus 15*a* defined between the tubulars 15*i, o* to the inner tubular 15*i*. The first inlet portion 5*a* may be tangentially or eccentrically attached to the inner tubular 15*i* so that the production fluid 25 is centrifugally accelerated into a bore of the inner tubular.

The first inlet portion 5*a* may include a first sub-portion attached to a wall of the inner tubular 15*i*, such as by welding and a second sub-portion attached to a wall of the outer tubular 15*o*, such as by welding. The first and second sub-portions may be connected, such as by a flange to facilitate assembly. The nozzle 5*b* may be connected to the first inlet portion 5*a*, such as with a flange or weld. The second portion 5*c* may be connected to the nozzle 5*b*, such as with a flange or weld. The second diameter may be greater or substantially greater than, such as two to four times, the first diameter. A length of the second portion 5*c* may be substantial, for example five to fifteen times the second diameter. The third portion 5*d* may be connected to the second portion 5*b*, may be horizontal, and have a substantial length, for example five to fifteen times the second diameter.

The inner tubular 15*i* may be centrally disposed within the bore of the outer tubular 15*o*. The inner tubular 15*i* may be attached to the outer tubular 15*o* via the support 20. The support 20 may include a plurality of ribs welded to the tubulars 15*i, o* so that flow in the annulus 15*a* is not unduly obstructed. Ends of the inner tubular 15*i* may be exposed to the bore of the outer tubular 15*o*, thereby providing fluid communication between the inner tubular and the outer tubular bore. A diameter of the inner tubular 15*i* may range from one-sixth to two-thirds or one-fourth to two-fifths of a diameter of the outer tubular 15*o*. The inner tubular 15*i* may extend a substantial length of the outer tubular 15*o*, such as one-half to nine-tenths the length of the outer tubular 15*o*. The diameter of the outer tubular 15*o* may range from one-sixth to two-thirds or one-fourth to two-fifths of the length of the outer tubular 15*o*. The inner tubular diameter may be equal or substantially equal to the second diameter.

The gas outlet 10*g* may be attached to the outer tubular 15*o* near an upper end thereof, such as by welding, and extend through the wall thereof into an upper end of the outer tubular bore or the flange 35. Alternatively, the gas outlet 10*g* may be attached to the blind flange 35. The gas outlet 10*g* may include a first portion attached to the outer tubular 15*o* and a second portion extending into the upper end of the outer tubular and fastened to the first portion, such as with a flange, to facilitate assembly. The liquid outlet 10*l* may be attached to the outer tubular 15*o* near a lower end thereof, such as by welding, and extend through the wall thereof into a lower end of the outer tubular bore or the head 30. Alternatively, the liquid outlet may be attached to the head 30.

In operation, the multiphase production stream 25 may enter the inlet portion 5*d*. Flow through the inlet portion 5*d* may precondition the production stream. Flow continues through the inlet portion 5*c* may stratify into liquid 25*l* and gas 25*g* phase components as a result of the declination angle 29 of the inlet 5. The production stream 25 may then be longitudinally accelerated by entering the nozzle 5*b*. The production stream 25 may continue through the inlet portion 5*a* and may be centrifugally accelerated upon entering the inner tube 15*i*. As a result of the centrifugal acceleration and the downward longitudinal acceleration, the denser liquid portion 25*l* may tend to downwardly spiral along a wall of the inner tubular 15*i* in a ribbon-like flow pattern, whereas a lighter gas portion 25*g* may tend to migrate toward the center of the inner tubular bore and rise upward toward an upper end of the inner tubular 15*i*.

The liquid portion 25*l* may exit the inner tubular into a lower portion of the outer tubular 15*o*. The liquid portion may decelerate upon entering the lowering portion of the outer tubular 15*o*. Deceleration of the liquid portion 25*l* may allow additional gas 25*g* retained in the liquid portion to escape and rise up the annulus 15*a*, thereby acting as a second stage of separation and improving performance. The separator 1 may be sized and controlled to maintain a liquid level in the annulus between the tubulars 15*i, o*. The liquid level may be maintained between a minimum, such as the lower end of the inner tubular 15*i* and a maximum, such as proximately below a junction of the inlet portion 5*c* and the inner tubular 15*i*.

Maintenance of a liquid level provides a retention time of the liquid portion 25*l* to ensure that the liquid portion 25*l* and gas portion 25*g* reach equilibrium at separator pressure, thereby improving separator performance. The lower portion of the outer tubular 15*o* and the annulus may be sized (relative to expected flow rate of liquid) so that a sufficient retention time, such as thirty seconds to five minutes, may be sustained. The retention time also provides reaction time for a separator control system (i.e., FIG. 3) to react to dramatic changes in a liquid volume ratio (LVR) of the production stream 25. For example, if the production stream includes a gas slug, the LVR of the production stream may instantaneously decrease from a substantial LVR to about zero. If an insufficient volume of liquid is retained in the separator, then gas may exit the liquid outlet 10 before the control system reacts. Conversely, if the production stream includes a liquid slug, then liquid may exit the gas outlet 10*g*.

Figure 2:
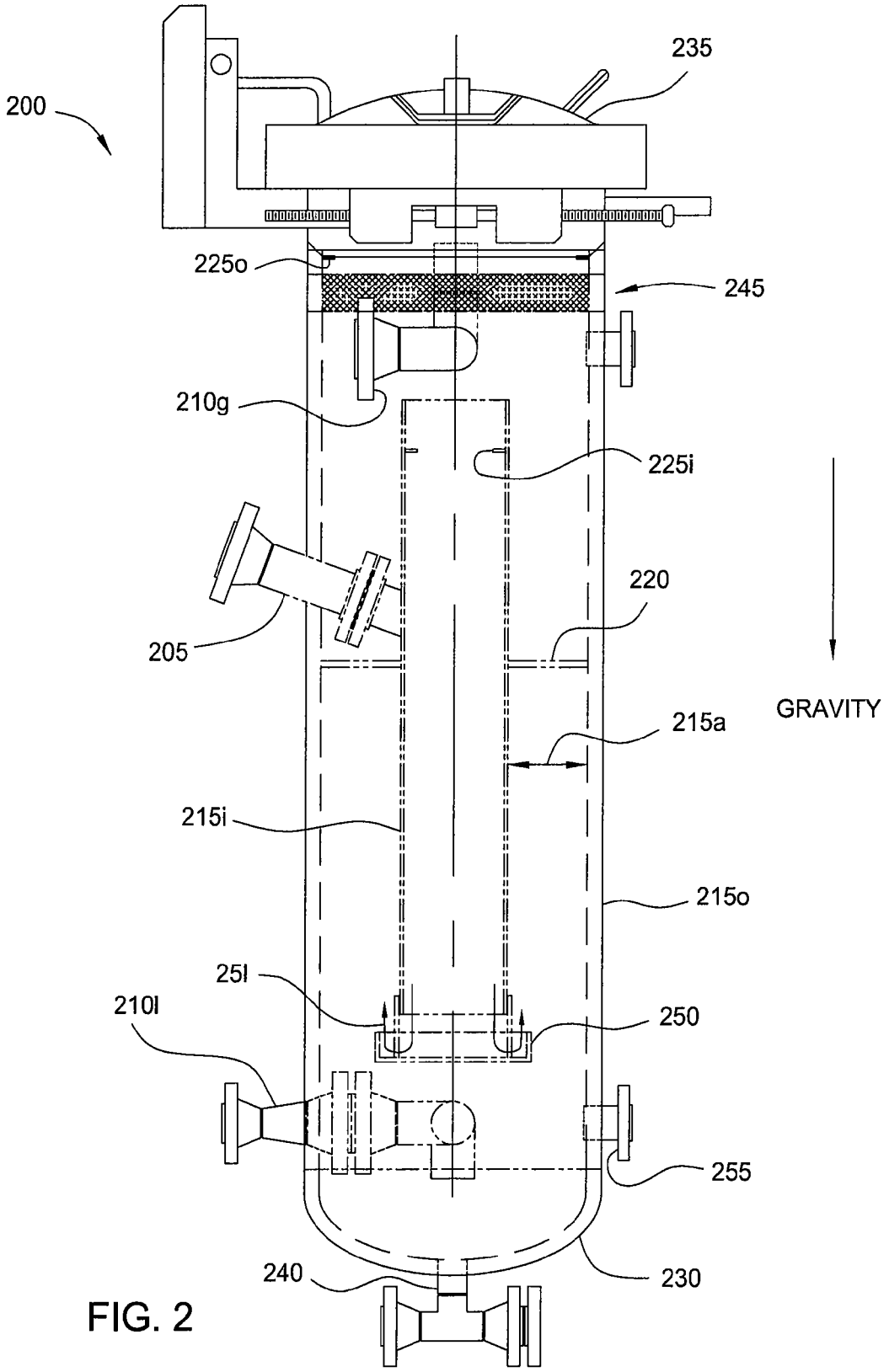
FIG. 2 is a side view of a centrifugal separator, according to another embodiment of the present invention.
Figure 2A:
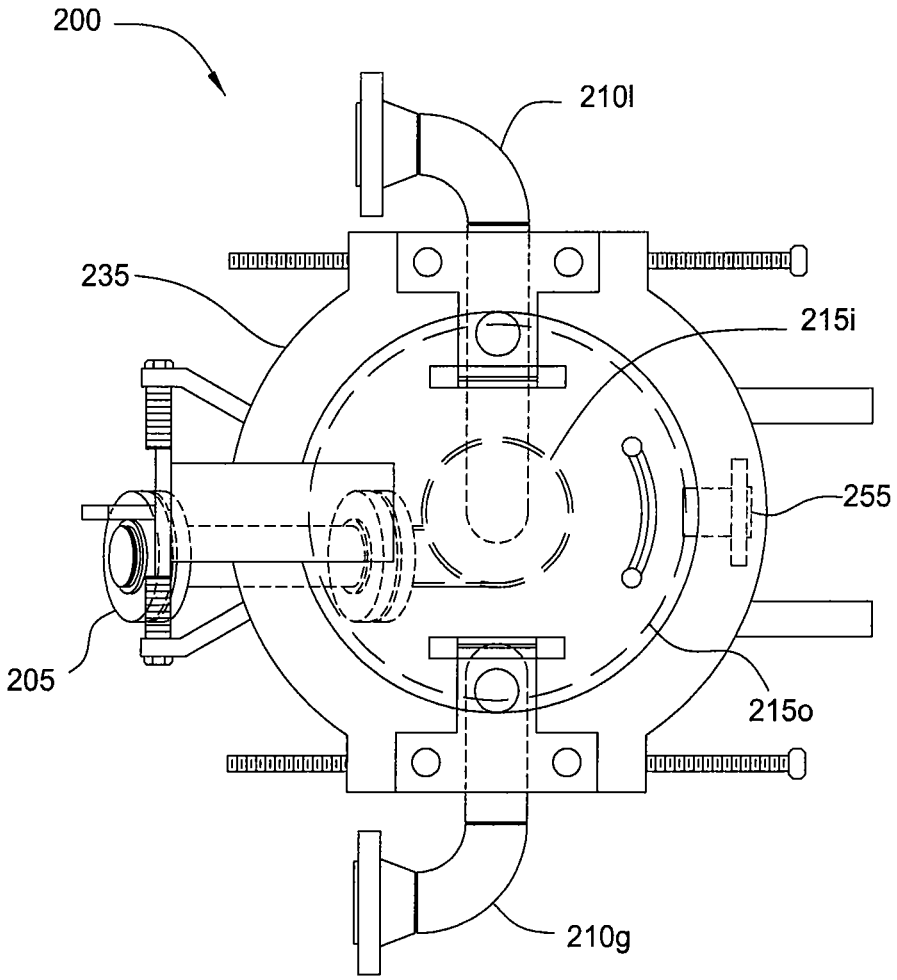
FIG. 2A is a plan view of the separator of FIG. 2.

FIG. 2 is a side view of a centrifugal separator 200, according to another embodiment of the present invention. FIG. 2A is a plan view of the separator 200. The separator 200 may include an inlet 205, a gas outlet 210*g*, a liquid outlet 210*l*, an outer tubular 215*o*, an inner tubular 215*i*, a support 220, one or more liquid film breakers 225*i, o*, longitudinal caps 230, 235, a drain 240, a mist extractor 245, a vortex breaker 250, and level sensor taps 255. Even though only the second inlet portion 205 is shown, the inlet 205 may further include the first inlet portion 5*a* and the nozzle 5*b*. The separator 200 may be similar to the separator 1 in basic form and operation so only differences are discussed below.

The vortex breaker 250 may be disposed on a lower longitudinal end of the inner tubular 215*i*. The vortex breaker 250 may be an annular member, such as a, ring having a substantially C-shape cross-section and a diameter slightly greater than a diameter of the inner tubular 215*i*. The ring may be attached to the inner tubular using rods welded to the ring 250 and the inner tubular 215*i*. The rods may be sized so that a longitudinal gap is defined between the lower end of the inner tubular and a facing longitudinal end of the ring, thereby providing a sufficient flow path through the ring. During operation of the separator 200, a gas filament may develop in the center of the inner tubular 215*i*. If the gas filament extends downward to the liquid outlet, gas may escape into the liquid outlet. The vortex breaker may prevent the gas filament from forming or extension of the gas filament past the vortex breaker and toward the liquid outlet 210*l* by reversing flow of the liquid portion 25*l*. Alternatively, the vortex breaker may be a flat ring, thereby turning flow of the liquid portion by ninety degrees. Alternatively, the vortex breaker may be a post centrally disposed in the inner tubular bore at the lower end of the inner tubular. The post may be attached to the inner tubular using ribs welded to the post and the inner tubular. The post may prevent or limit formation of the gas filament without substantially affecting flow of the liquid portion 25*l*.

Each of the liquid film breakers 225*i, o* may be disposed at or near an upper longitudinal end of a respective tubular 215*i, o*. Each of the liquid film breakers 225*i, o* may include an annular member, such as a ring extending slightly inward from a respective inner surface of a respective tubular 215*i,o*. The rings may be attached to the respective tubular, such as by welding, or longitudinally coupled to a respective tubular, such as by snapping into a respective groove formed in an inner surface of a respective tubular. During operation of the separator 200, a liquid film may tend to be drawn up inner surfaces of the tubes 215*i, o*. If the liquid film extends upward into the gas outlet 210*g*, liquid may escape into the gas outlet.

The mist extractor 245 (a.k.a. demister) may be of the vane type or the knitted wire type. The vane type may include a labyrinth formed with parallel sheets with liquid collection pockets. The gas portion 25*g* in passing between the plates may be agitated and forced to change direction a number of times. As the gas portion 25*g* changes direction, the heavier liquid droplets 25*l* suspended therein may tend to be expelled to the outside and caught in the pockets. The vane type may further include a liquid collection pas incorporating a liquid seal, thereby allowing for drainage of the liquid 25*l* from the mist extractor 245. The knitted wire type may include a wire knitted into a pad having multiple unaligned, asymmetrical openings. Void volume may be greater than or equal to ninety percent. The gas portion 25*g* passing through the pad may be forced to change direction a number of times. Liquid droplets 25*l* suspended in the gas portion may strike the wire and flow downward into capillary space provided by adjacent wires. The liquid may collect and migrate downward. Surface tension may retain the droplets 25*l* on a lower face of the pad until they are large enough for the downward force of gravity to exceed the upward drag force due to gas velocity and surface tension.

Figure 2B:
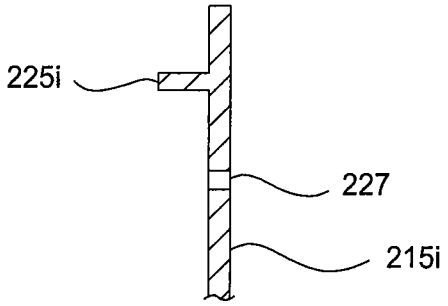
FIG. 2B is a cross section of a portion of an inner tubular, according to another embodiment of the present invention.

FIG. 2B is a cross section of a portion of an inner tubular 215*i*', according to another embodiment of the present invention. One or more radial ports 227 may be formed through the wall of the inner tubular 215*i*' proximately below the film breaker 225*i*'. The port may improve the performance of the film breaker 225*i*' by allowing a portion of the liquid film to discharge therethrough into the annulus 215*a*. Alternatively, the film breaker 225*i*' may be omitted.

Figure 3:
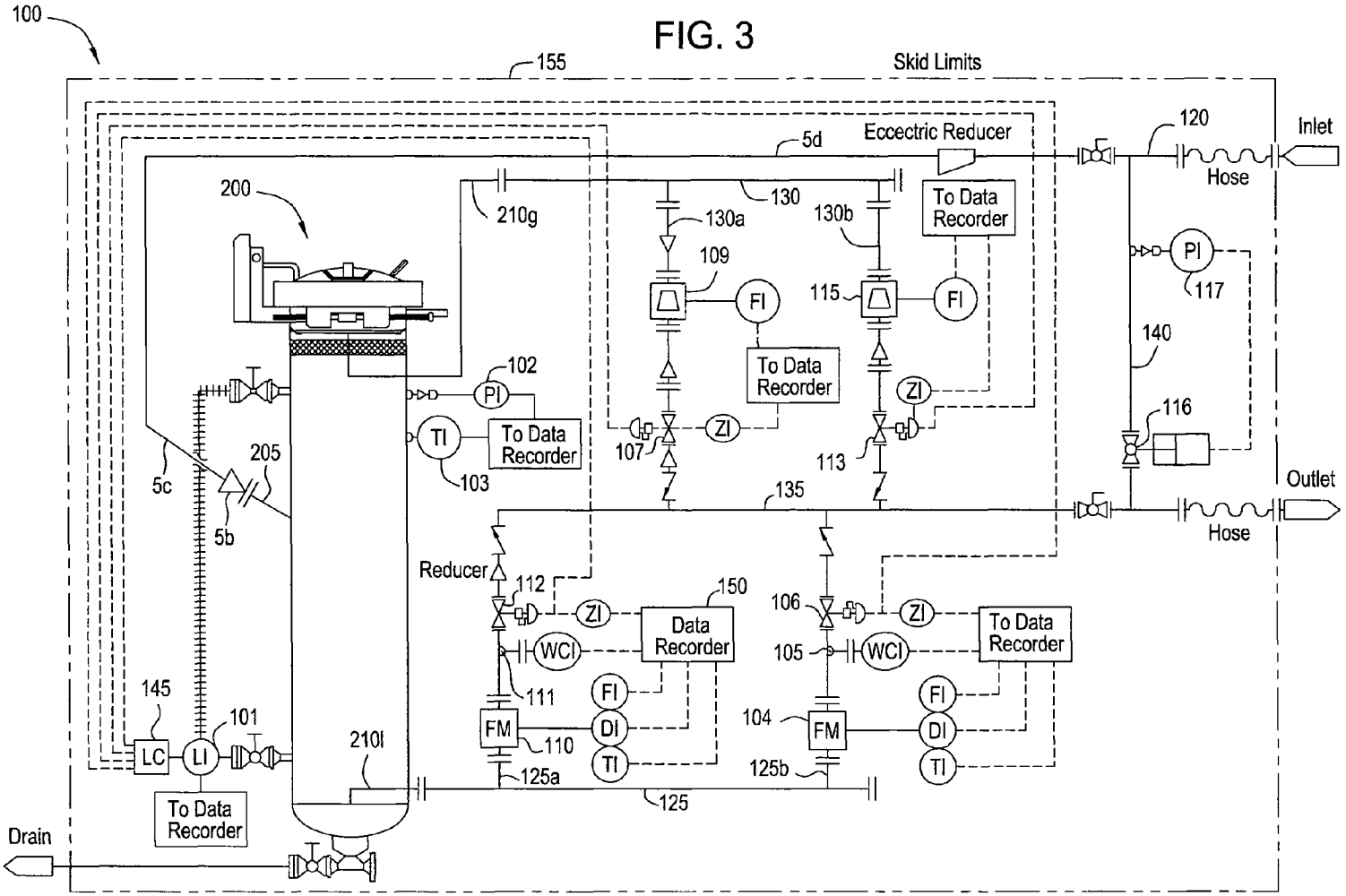
FIG. 3 is a process flow diagram of a well tester, according to another embodiment of the present invention.

FIG. 3 is a process flow diagram of a well tester 100, according to another embodiment of the present invention. The well tester 100 may be packaged on a skid 155 to provide portability. The well tester 100 may be used for a potential test, as discussed above. The well tester 100 may also be used to perform an extended production test. The well tester may include an inlet 120, the separator 200, a liquid line 125, a gas line 130, an outlet 135, a bypass 140, level controller 145, and a data recorder 150. Alternatively, the separator 1 may be used instead of the separator 200.

The inlet 120 may include a hose, a conduit, an open/close valve, and a reducer to transition conduit diameter to the third inlet portion 5*d* of the separator 200. The liquid line 125 may include a header and one or more legs 125*a, b*. Each leg 125*a, b* may include a flow meter 104, 110, a water cut meter 105, 111, a level control valve 106, 112, and a check valve. The gas line 130 may include a header and one or more legs 130*a, b*. Each leg 130*a, b* may include a flow meter 109, 115, a pressure control valve 106, 112, and a check valve. Each of the legs 125*b*, 130*b* may be greater in the diameter than respective legs 125*a*, 130*a* and include flow meters 104, 115 having a different operating range than respective flow meters 110, 109. In this manner, if the flow range of a given flow meter is less than the flow range of the separator, then the legs 125*a*, 130*a* may be operated for lower production stream 25*a* flow rates, legs 125*b*, 130*b* may be operated for medium production stream flow rates, and legs 125*a, b* and 130*a, b* may be operated for higher production stream flow rates.

The liquid flow meters 104, 110 may be Coriolis meters and may measure a flow rate, a density, and a temperature of the liquid portion 25*l*. The water cut meters 105, 111 may be optical near infrared spectroscopy meters. The gas flow meters 109, 115 may be vortex meters and may measure a flow rate of the gas portion 25*g*. Each of the meters and the level control valves may be in data communication with the data recorder 150. The data recorder 150 may be a microprocessor based computer and may process the measurements. The data recorder 150 may be located on the skid, at the well-site, or at a remote facility. The data recorder 150 may include a display to allow an operator to view the measurements in real time. A pressure sensor 102 and a temperature sensor 103 may be located on the separator and in communication with an upper portion of the outer tubular bore or annulus 215*a*. The sensors 102, 103 may also be in data communication with the data recorder 150.

A level sensor 101 may be in fluid communication with the level taps 255. The level sensor 101 may be in data communication with the level controller 145. The level controller 101 may be microprocessor based and may include a hydraulic pump or compressor, solenoid valves, and an analog and/or digital user interface. The level controller may be in hydraulic, pneumatic, or electrical communication with the control valves 106, 107, 112, and 113. The level controller 101 may operate the level control valves 106, 112 to maintain a predetermined liquid level in the separator 200 and the pressure control valves 107, 113 to maintain a predetermined gas pressure in the separator (depending on which legs 125*a, b* and 130*a, b* are being operated for a given test).

After flow measurement, the liquid portion 25*l* and gas portion from the legs 125*a, b* and 130*a, b* are combined in the outlet 135. The outlet 135 may include a header, an open/close valve, and a hose. The bypass 140 may include a conduit, a pressure sensor 117, and a relief valve 116. The relief valve 116 may include an open/close valve, a pressure controller, and an actuator. The pressure controller may be in communication with the pressure sensor 117 and may monitor the pressure in the inlet 120 to determine if the inlet pressure is greater than or equal to a predetermined set pressure, such as the design pressure of the separator 200. If so, then the pressure controller may operate the actuator and open the valve, thereby bypassing the separator 200.

Alternatively, the well tester 100 may be modified for use as a production separator. In this alternative, a gas outlet and a liquid outlet would be provided instead of combining the gas portion 25*g* and the liquid portion 25*l*. The gas outlet may be lead to a gas sales line or to a flare and the liquid outlet to a storage tank or sales line. The bypass line 140 may be replaced by a pressure operated relief valve located at an upper end of the separator 200 having an outlet to a flare.

Figure 4A:
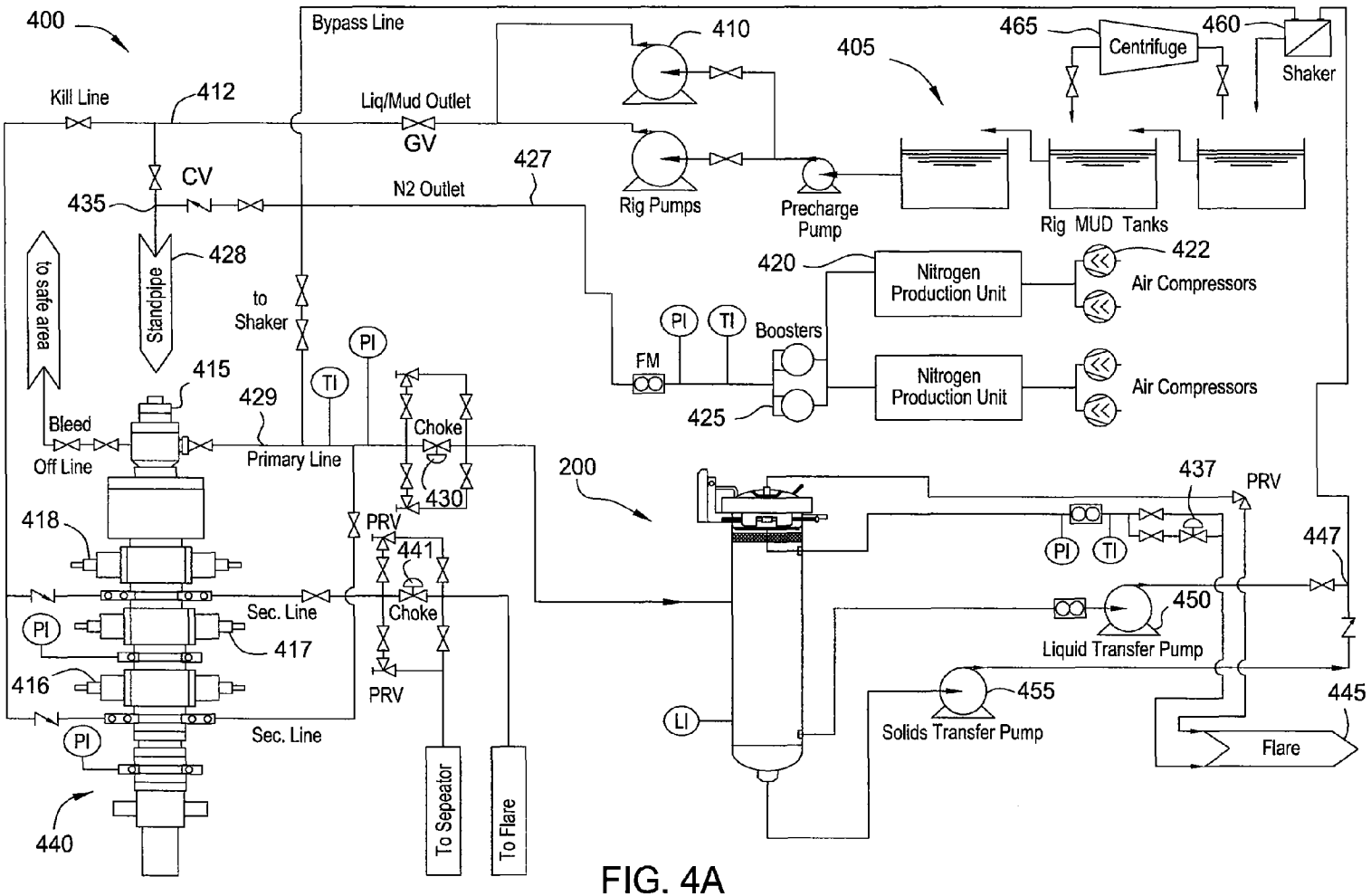
FIG. 4A is a flow diagram of a drilling system, according to another embodiment of the present invention.
Figure 4B:
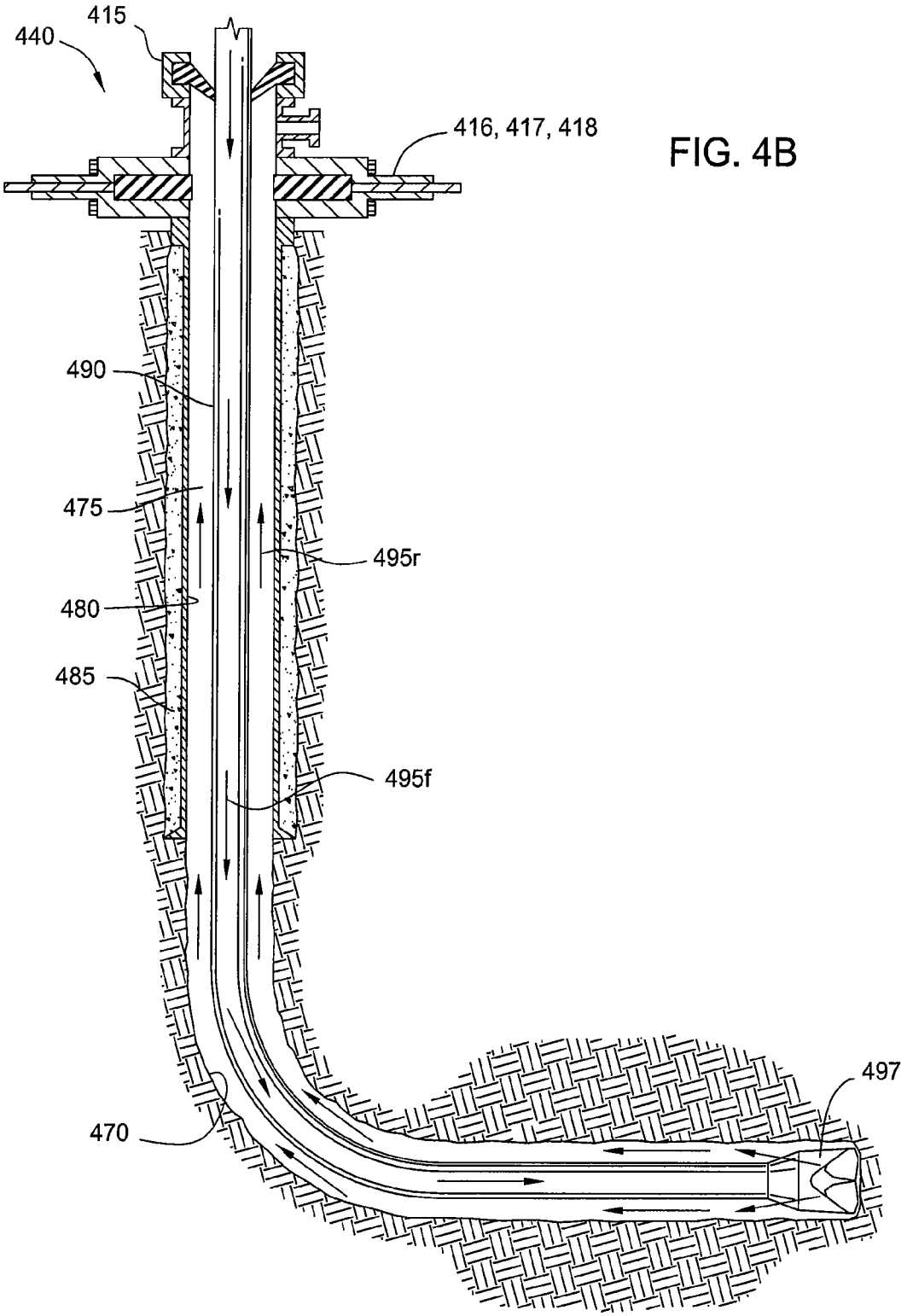
FIG. 4B is a cross-section of a wellbore being drilled using the drilling system.

FIG. 4A is a flow diagram of a drilling system 400, according to another embodiment of the present invention. FIG. 4B is a cross-section of a wellbore 470 being drilled using the drilling system 400. Aspects of drilling system 400 are discussed in more detail in U.S. Prov. App. No. 61/089,456, now U.S. Pat App. Pub. No. 2010/0147591, which is herein incorporated by reference in its entirety. The drilling system 400 may be deployed on land or offshore. The drilling system may be used to drill non-productive and/or productive formations. The drilling system 400 may include a drilling rig (not shown) used to support drilling operations. The drilling rig may include a derrick supported from a support structure having a rig floor or platform on which drilling operators may work. Many of the components used on the rig such as a Kelly and rotary table or top drive, power tongs, slips, draw works and other equipment are not shown for ease of depiction. A wellbore 470 has already been partially drilled, casing 480 set and cemented 485 into place. The casing string 480 may extend from the surface of the wellbore 470 where a wellhead 440 is typically located. Drilling fluid 495*f* may be injected through a drill string 490 disposed in the wellbore 470.

The drilling fluid 495*f* may be a mixture and may include a first fluid which is a gas (at standard temperature and pressure (STP, 60° F. 14.7 psia)) and a second fluid which is a liquid (at STP). The mixture may be heterogeneous (i.e., insoluble) or homogenous (i.e., a solution) and may vary in properties (i.e., density and/or phases) in response to temperature and/or pressure. The liquid may be water, glycerol, glycol, or base oil, such as kerosene, diesel, mineral oil, fuel oil, vegetable ester, linear alpha olefin, internal olefin, linear paraffin, crude oil, or combinations thereof. The gas may be any gas having an oxygen concentration less than the oxygen concentration sufficient for combustion (i.e., eight percent), such as nitrogen, natural gas, or carbon dioxide. The nitrogen may be generated at the surface using a nitrogen production unit which may generate substantially pure (i.e., greater than or equal to ninety-five percent pure) nitrogen. Alternatively, the nitrogen may be delivered from cryogenic bottles. The gas may be a mixture of gases, such as exhaust gas from the rig's prime mover or a mixture of nitrogen, natural gas, and/or carbon dioxide.

Alternatively, the second fluid may be a mud (liquid/solid mixture). The mud may be oil-based and may have water emulsified therein (invert emulsion). The solids may include an organophilic clay, lignite, and/or asphalt. The base oil may be viscosified. Alternatively, the mud may be water-based. The solids may be dissolved in the liquid, forming a solution, such as brine. The dissolved solids may include metal halides, such as potassium, cesium, or calcium salts or mixtures thereof; or formates, such as cesium, sodium, potassium, lithium, or mixtures thereof. The brine may be a mud and further include silicates, amines, oils, such as distillated hydrocarbons, olefins, or paraffins. The brine may further include hydration and dispersion inhibiting polymers, such as polyanionic cellulose (PAC), partially hydrolyzed polyacrylamide (PHPA), partially hydrolyzed polyacylanitrile (PHPAN) fluids). Alternatively, the mud may be glycol based. The glycol-based mud may include a water-miscible glycol, with a molecular weight of less than about 200, a salt, an anti-sticking additive; a filtration control agent for lowering fluid loss of the drilling fluid; a viscosifier for suspension of solids and weighting material in the drilling fluid, and weighting material. Alternatively, the mud may be an oil in water emulsion.

Additionally, if the liquid/mud is oil or oil based, one or more solid hydrophilic polymer prills may be added to the drilling fluid. If water from an exposed formation should enter the annulus, the prill will absorb the water and swell up, thereby facilitating removal from the returns by the solids shaker.

Injection rates of the gas portion and the liquid/mud portion of the drilling fluid may be controlled to achieve a predefined liquid volume fraction (LVF), such as 0.01 to 0.025 at STP. Alternatively, the injection rates may be controlled to achieve a predefined equivalent circulating density (ECD) at a top of an exposed formation or at total depth, such as 100 to 1,000 kg/m$^3$ or 200 to 700 kg/m$^3$. Alternatively, the injection rates may be controlled to achieve a predefined ECD at a top of an exposed formation or at total depth so that the pressure exerted on or more exposed formations by the drilling fluid is less than or substantially less than the pore pressure of the exposed formation(s). Alternatively, the injection rates may be controlled to achieve a predefined LVF at total depth, such as greater than 0.5. Alternatively, the injection rates may be controlled so that a first flow regime (discussed below) is maintained in a lower portion of the annulus, such as along the BHA, and a second flow regime is maintained in an upper portion of the annulus, such as from an upper end of the BHA to at or near the surface.

The liquid/mud portion of the drilling fluid **495*f* may be stored in a reservoir, such as one or more tanks 405 or pits. The reservoir may be in fluid communication with one or more rig pumps 410 which pump the liquid/mud portion through an outlet conduit 412, such as pipe. The outlet pipe 412 may be in fluid communication with a nitrogen outlet line 427 and a standpipe 428**.

The gas portion of the drilling fluid **495*f* may be produced by one or more nitrogen production units (NPUs) 420. Each NPU 420 may be in fluid communication with one or more air compressors 422. The compressors 422 may receive ambient air and discharge compressed air to the NPUs 420. The NPUs 420 may each include a cooler, a demister, a heater, one or more particulate filters, and one or more membranes. The membranes may include hollow fibers which allow oxygen and water vapor to permeate a wall of the fiber and conduct nitrogen through the fiber. An oxygen probe (not shown) may monitor and assure that the produced nitrogen meets a predetermined purity. One or more booster compressors 425 may be in fluid communication with the NPUs 420. The boosters 425 may compress the nitrogen exiting the NPUs 420** to achieve a predetermined injection or standpipe pressure. The boosters may be positive displacement type, such as reciprocating or screw, or turbomachine type, such as centrifugal.

A pressure sensor (PI), temperature sensor (TI), and flow meter (FM) may be disposed in the nitrogen outlet 427 and in data communication with a surface controller (SC, not shown). The SC may monitor the flow rate of the nitrogen and adjust the air compressors and/or booster compressors to maintain a predetermined flow rate.

The liquid/mud portion and gas portion of the drilling fluid **495*f* may be commingled at the junction 435 of the outlet lines, thereby forming the drilling fluid 495*f*. The drilling fluid may flow through the standpipe 428 and into the drill string 490 via a swivel (Kelly or top drive). The drilling fluid 495*f* may be pumped down through the drill string 490 and exit the drill bit 497, where the fluid 495*f* may circulate the cuttings away from the bit 497 and return the cuttings up an annulus 475 defined between an inner surface of the casing 480 or wellbore 470 and an outer surface of the drill string 490. The return mixture (returns) 495*r* may return to the surface and be diverted through an outlet of a rotating control device (RCD) 415 and into a primary returns line (PRL) 429**.

The RCD 415 may provide an annular seal around the drill string 490 during drilling and while adding or removing (i.e., during a tripping operation to change a worn bit) segments or stands to/from the drill string 490. The RCD 415 may achieve fluid isolation by packing off around the drill string 490. The RCD 15 may include a pressure-containing housing mounted on the wellhead 440 where one or more packer elements are supported between bearings and isolated by mechanical seals. The RCD 415 may be the active type or the passive type. The active type RCD uses external hydraulic pressure to activate the packer elements. The sealing pressure is normally increased as the annulus pressure increases. The passive type RCD uses a mechanical seal with the sealing action activated by wellbore pressure. If the drillstring 490 is coiled tubing or segmented tubing using a mud motor, a stripper (not shown) may be used instead of the RCD 415. One or more blowout preventers (BOPs) 416-418 may be attached to the wellhead 40. If the RCD is the active type, it may be in communication with and/or controlled by the SC. The RCD may include a bleed off line to vent the wellbore pressure when the RCD is inactive.

A TI and PI may be disposed in the PRL 429 and in data communication with the SC. A control valve or a variable choke valve 430 may be disposed in the PRL 429. The choke 430 may be in communication with the SC and fortified to operate in an environment where the returns **495*r* contain substantial drill cuttings and other solids. The choke 430 may be fully open or bypassed during normal drilling and present only to allow the SC to control backpressure exerted on the annulus 475 should a kick be occur. Alternatively, the choke 430** may be employed during normal drilling to exert a predetermined back pressure on the annulus.

The drill string 490 may include the drill bit 497 disposed on a longitudinal end thereof. The drill string 490 may be made up of joints or segments of tubulars threaded together or coiled tubing. The drill string 490 may also include a bottom hole assembly (BHA) (not shown) that may include the bit 497, drill collars, a mud motor, a bent sub, measurement while drilling (MWD) sensors, logging while drilling (LWD) sensors and/or a check or float valve (to prevent backflow of fluid from the annulus). The mud motor may be a positive displacement type (i.e., a Moineau motor) or a turbomachine type (i.e., a mud turbine). The drill string may further include float valves distributed therealong, such as one in every joint or stand, to maintain the drilling fluid therein while adding joints thereto. The drill bit 497 may be rotated from the surface by the rotary table or top drive and/or by the mud motor. If a bent sub and mud motor is included in the BHA, slide drilling may be effected by only the mud motor rotating the drill bit and rotary or straight drilling may be effected by rotating the drill string from the surface slowly while the mud motor rotates the drill bit. Alternatively, the drill string 490 may be a second casing string or a liner string in which case the liner or casing string may be hung in the wellbore and cemented after drilling.

The returns 495*r* may then be processed by the separator 200. Alternatively, the separator 1 may be used instead. The liquid outlet 210*l* of the separator 200 may feed a liquid transfer pump 50. An FM may be disposed in the liquid outlet line and in communication with the SC. The drain 240 may collect solids and feed a solids transfer pump 455. An outlet line from the solids transfer pump may intersect an outlet line of the liquid transfer pump at tee 447. The recombined liquid/mud and solids may flow through a combined outlet to a solids shaker 460. The separator 200 may include a level sensor (LI) in data communication with the SC for detecting the liquid/mud level in the separator.

The separator 200 may further include a gas outlet 210*g* to a flare 445 or gas recovery line. The gas outlet line may include a FM, PI, and TI in data communication with the SC. These sensors allow the SC to measure the flow rate of returned gas. The gas outlet line may further include an adjustable choke 437 in communication with the SC which may be used to control pressure in the separator and/or to control back pressure exerted on the annulus if erosion of the choke 430 becomes a problem.

The solids shaker 460 may remove heavy solids from the liquid/mud and may discharge the removed solids to a solids bin (not shown). An outlet line of the shaker 460 may lead to a first of the tanks 405. An outlet of the first tank 405 may feed a centrifuge 465 which may remove fine solids from the liquid/mud and discharges the removed fines to the bin. The solids bin may include a load cell in data communication with the SC. An outlet line of the centrifuge 465 may discharge the liquid/mud into a second one of the mud tanks 405.

A bypass line may be included to provide the option of closing the PRL and bypassing the choke 430 and the separator 200. The bypass line may lead directly to the solids shaker 450. The bypass line may be used to return to conventional overbalanced drilling in the event that the wellbore becomes unstable (i.e., a kick or an unstable formation). One or more secondary lines (Sec. Line) may be provided to allow circulation in the event that one or more of the BOPs 416-418 are closed. As shown, one of the secondary lines leads to the choke 430 and one of the secondary lines includes a choke 441 which leads to the flare 445 and/or separator 200.

Stands may have to be removed or added if the drill string 490 has to be removed or tripped to change the drill bit 497. During adding or removing stands, the NPUs 420 may be shut down so that only the liquid/mud is injected through the drill string 490. The nitrogen outlet line 427 may be vented to the separator or atmosphere by a bleed off line (not shown). The circulation may be continued until the annulus is filled to a predetermined level, such as partially, substantially, or completely, with the liquid/mud. Once the annulus is filled to the predetermined level, circulation may be halted by shutting the rig pumps down. The predetermined level may be selected so that the exposed formations are near-balanced or overbalanced. If a stand is being removed, the liquid/mud may be added via the kill line to maintain the liquid/mud level in the annulus. This process may also be used for adding joints to the drill pipe. Alternatively, if the density of the liquid/mud is insufficient for overbalancing the exposed formation(s), a more dense liquid/mud may be used to overbalance the exposed formation(s). This more dense liquid/mud may be premixed in a kill tank or may be formed by adding weighting agents to the liquid/mud. Alternatively, a continuous circulation system or continuous flow subs may be used to maintain circulation while adding or removing joint/stands to/from the drill string.

Various gate valves (GV), check valves (CV), and pressure relief valves (PRV) are shown. The gate valves may be in communication with the SC so that they are opened or closed by the SC.

Figure 5A:
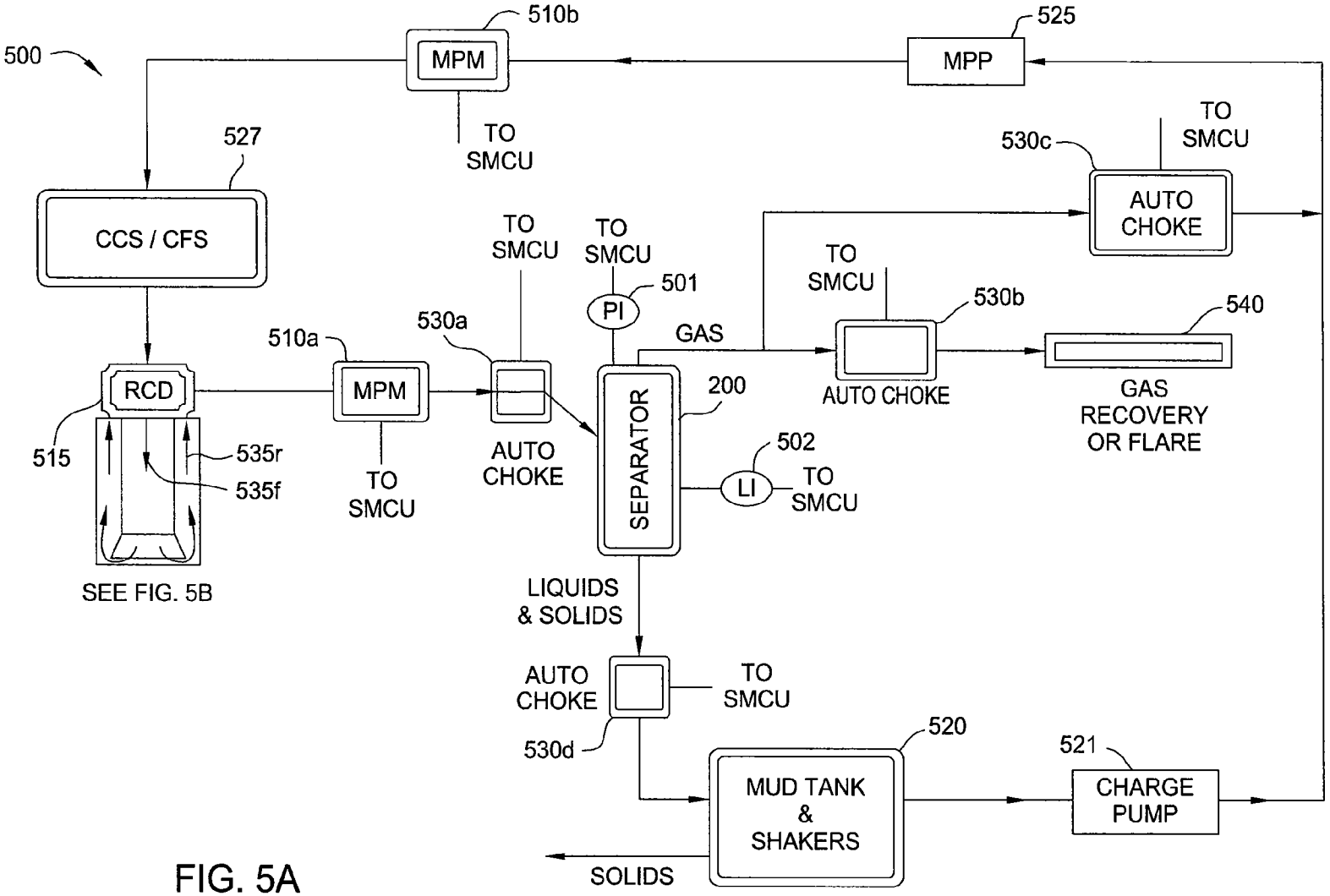
FIG. 5A illustrates a drilling system, according to another embodiment of the present invention.
Figure 5B:
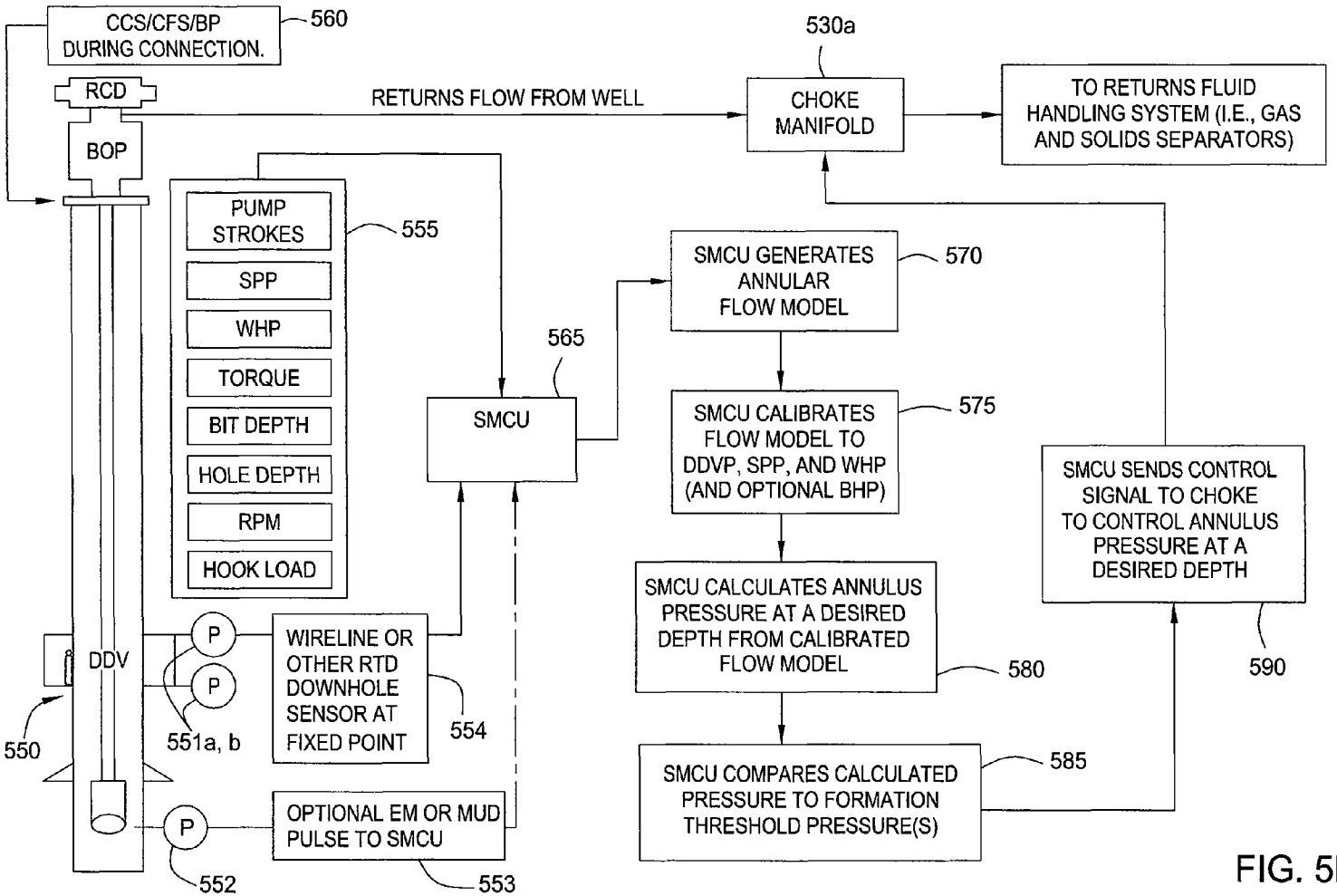
FIG. 5B is a flow diagram illustrating operation of a surface monitoring and control unit (SMCU) of the drilling system.

FIG. 5A illustrates a drilling system 500, according to another embodiment of the present invention. FIG. 5B is a flow diagram illustrating operation of a surface monitoring and control unit (SMCU) 565 of the drilling system 500. Aspects of drilling system 500 are discussed in more detail in U.S. Pat. App. Pub. No. 2008/0060846, which is herein incorporated by reference in its entirety. The drilling system 500 may include a drilling rig and drill string, similar to that discussed above for the drilling system 400.

The drilling system 500 may be capable of injecting a multiphase drilling fluid 535*f*, i.e. a liquid/gas mixture. The liquid may be oil, oil based mud, water, or water based mud, and the gas may be nitrogen or natural gas. Returns 535*r* exiting an outlet line of the RCD 515 may be measured by a multi-phase meter (MPM) 510*a*. The MPM 510*a* may be in communication with the SMCU 565 and may measure a pressure (or pressure and temperature) at the RCD outlet and communicate the pressure to the SMCU 565 in addition to component flow rates. The returns 50r may continue through the RCD outlet line through the choke 530*a* which may control back pressure exerted on the annulus and may be in communication with the SMCU 565. The returns 535*r* may flow through the choke 530*a* and into the separator 200. Alternatively, the separator 1 may be used instead. The liquid level in the separator may be monitored and controlled by the level sensor 502 and choke 530*d* which are both in communication with the SMCU 565.

The liquid and cuttings portion of the returns 535*r* may exit the separator 200 through the liquid outlet and through the choke 530*d* disposed in the liquid outlet. The liquid and cuttings may continue through the liquid line to shakers 520 which may remove the cuttings and into a mud reservoir or tank 520. The liquid portion of the returns 535*r* may then be recycled as drilling fluid 535*f*. Liquid drilling fluid may be pumped from the mud tank 520 by a charge pump 521 into an inlet line of a multi-phase pump (MPP) 525.

The gas portion of the returns 535*r* may exit the separator 200 through the gas outlet. The gas outlet line may split into two branches. A first branch may lead to an inlet line of the MPP 525 so that the gas portion of the returns 535*r* may be recycled. The second branch may lead to a gas recovery system or flare 540 to dispose or recover excess gas produced in the wellbore. Flow may be distributed between the two branches using chokes 530*b, c* which may both be in communication with the SMCU 565. The first branch of the gas outlet line and an outlet line of the mud tank 520 may join to form the inlet line of the MPP 525. The SMCU 565 may control the amount of gas entering the MPP inlet line, thereby controlling the density of the drilling fluid mixture 535*f*, to maintain a desired annulus pressure profile. The drilling fluid mixture 50*f* may exit the MPP 525 and flow through an MPM 510*b* which may be in communication with the SMCU 565.

A continuous flow sub (CFS) or continuous circulation system (CCS) 527 may maintain circulation and thus annulus pressure control during tripping of the drill string. A suitable CFS is discussed and illustrated in U.S. patent application Ser. No. 12/180,121, now U.S. Pat. App. Pub. No. 2009/0025930, which is herein incorporated by reference in its entirety. The CFS may be assembled with every joint or stand of the drill string. The CFS may include a tubular housing, a float valve disposed in the housing, a side port formed through a wall of the housing, and a removable plug disposed in the side port. The CFS may include an automated or semi-automated clamp which may engage the CFS, remove the plug, and provide circulation through the side port while making up or breaking out joints of drill pipe. The clamp may then replace the plug and drilling or tripping may continue.

A downhole deployment valve (DDV) 550 may be disposed in the casing near a bottom thereof. One or more casing pressure sensors 551*a, b* may be integrated with the DDV. A cable may be disposed along or within the casing string and provide communication between the DDV and the SMCU. The drill string may include a BHA disposed near the bit. The BHA may include a pressure sensor 552 and a wireless 553 (i.e., EM or mud pulse) telemetry sub or a cable extending through or along the drill pipe for providing communication between the pressure sensor and the SMCU.

In operation, the SMCU may input conventional drilling parameters 555, such as rig pump flow rate (from the flow meter FM), stand pipe pressure (SPP), well head pressure (WHP), torque exerted by the top drive (or rotary table), bit depth and/or hole depth, the rotational velocity of the drill string, and the upward force that the rig works exert on the drill string (hook load). The drilling parameters 555 may also include mud density, drill string dimensions, and casing dimensions.

Simultaneously, the SMCU 565 may input a pressure measurement 554 from the casing pressure sensor 551*a, b*. The communication between the SMCU and the drilling parameters sources and the casing sensor may be high bandwidth and at light speed. From at least some of the drilling parameters, the SMCU may calculate an annulus flow model or pressure profile 570. The SMCU may then calibrate the annulus flow model using at least one of: the casing pressure measurement, the SPP measurement, and the WHP measurement 575. Using the calibrated annulus flow model, the SMCU may determine an annulus pressure at a desired depth, such as bottomhole 580.

The SMCU 565 may compare the calculated annulus pressure to one or more formation threshold pressures (i.e., pore pressure or fracture pressure) to determine if a setting of the choke valve 530*a* needs to be adjusted 585. Alternatively, the SMCU may instead alter the injection rate of drilling fluid and/or alter the density of the drilling fluid. Alternatively, the SMCU may determine if the calculated annulus pressure is within a window defined by two of the threshold pressures. If the choke setting needs to be adjusted, the SMCU may determine a choke setting that maintains the calculated annulus pressure within a desired operating window or at a desired level (i.e., greater than or equal to) with respect to the one or more threshold pressures at the desired depth. The SMCU may then send a control signal to the choke valve to vary the choke so that the calculated annulus pressure is maintained according to the desired program 590. The SMCU may iterate this process continuously (i.e., in real time). This is advantageous in that sudden formation changes or events (i.e., a kick) can be immediately detected and compensated for (i.e., by increasing the backpressure exerted on the annulus by the choke).

The controller may also input a BHP from the BHA sensor 553. Since this measurement may be transmitted using wireless telemetry, the measurement may be not available in real time. However, the BHP measurement may still be valuable especially as the distance between the casing sensor and the BH becomes significant. Since the desired depth may be below the casing sensor, the controller may extrapolate the calibrated flow model to calculate the desired depth. Regularly calibrating the annular flow model with the BHP may thus improve the accuracy of the annulus flow model.

During adding or removing joints or stands to/from the drill string, the SMCU may also maintain the calculated annulus pressure with respect to the formation threshold pressure or window 560 using a continuous circulation system (CCS), a continuous flow sub (CFS) or back pressure (BP) using one or more of the chokes 530*a-d*.

Figure 6:
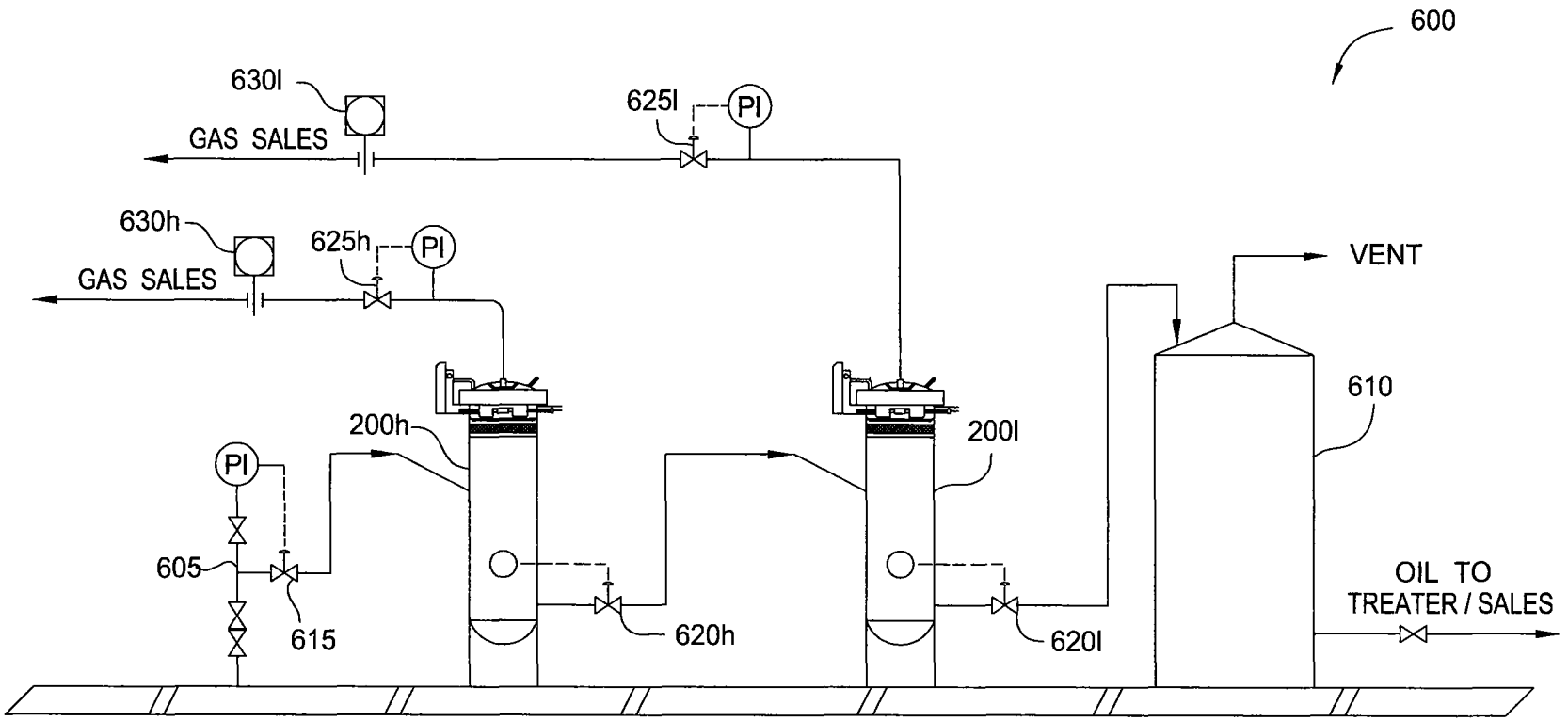
FIG. 6 is a process flow diagram of a production process system, according to another embodiment of the present invention.

FIG. 6 is a process flow diagram of a production process system 600, according to another embodiment of the present invention. The production process system 600 may include one or more pressure control valves 615, 625*h, i*; one or more separators, such as a high pressure separator 200*h* and a low pressure separator 200*i*; one or more gas flow meters 630*h, l*; and a storage tank 610. Alternatively, the separator 1 may be used instead for each of the high and low pressure separators. High pressure production fluid, such as crude oil and/or natural gas, may flow from a wellhead 605 into the high-pressure separator 200*h* where the initial separation of the high pressure gas stream and produced well liquids may occur.

From the high-pressure separator, the gas may flow through the pressure control valve 625*h* and the flow meter 630*h* to a sales gas line. The liquid from the high-pressure separator 200*h* passes through the level control valve 620*h* where the pressure may be reduced and may continue to the low-pressure separator 200*l*. A second separation may occur between the liquids and the lighter hydrocarbons in the liquids. The gas may be released from the low-pressure separator 200*l* through the pressure control valve 625*l* and the flow meter 630*l* to a sales gas line. From the low-pressure flash separator the liquid may be discharged though another level control valve 620*l* into the storage tank 610.

Additionally, the production fluid may be heated prior to choking through the pressure control valve 615. Heating of the production fluid may be done to prevent the formation of hydrates in the pressure control valve 615 or in one of the separators or sales lines. The low pressure gas discharged from the separator 200*l* may be used for both instrument and fuel gas for the heater and only excess gas may be discharged to the sales line. Additionally, a portion of the gas from the high-pressure separator may provide additional makeup gas for the instrument gas and fuel gas, if not enough gas was released from the low-pressure separator. Further the gas streams from one or both of the separators may be used for other utility purposes, such as fuel for compressor engines or other fired equipment on the well-site, such as reboilers, dehydrators, or acid gas sweetening units.

Additionally, one or more of the separators may 200*h, i* be three-phase separators to remove free water from the production stream. Additionally, a demulsifier or treater may receive the liquid from the low pressure separator 620*l* to remove emulsified water from the production stream prior to storage in the tank. Alternatively, the tank outlet may lead to the demulsifier or treater.

Alternatively, the production fluid may be methane and water from a coal bed wellhead.

Figure 7:
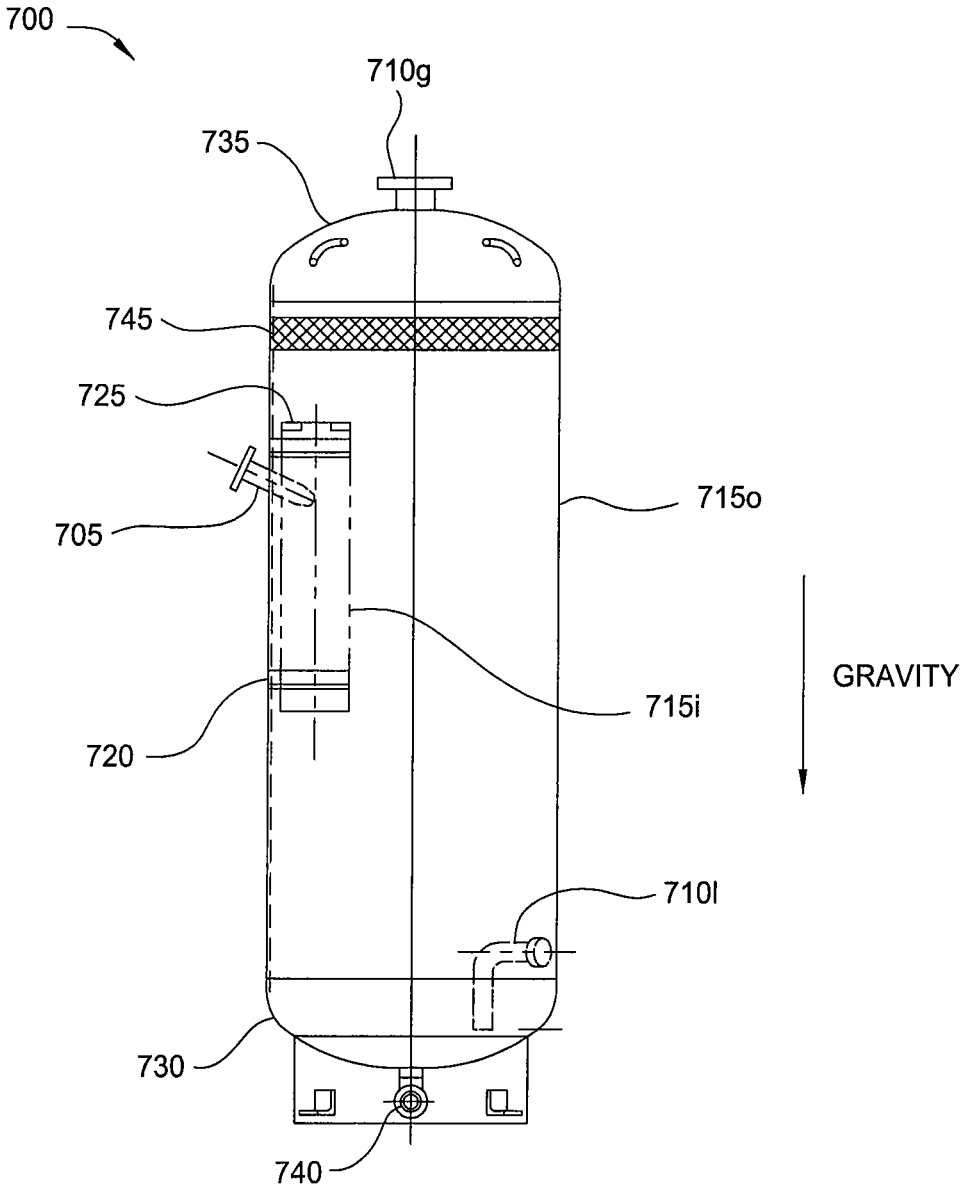
FIG. 7 is a side view of a centrifugal separator, according to another embodiment of the present invention.
Figure 7A:
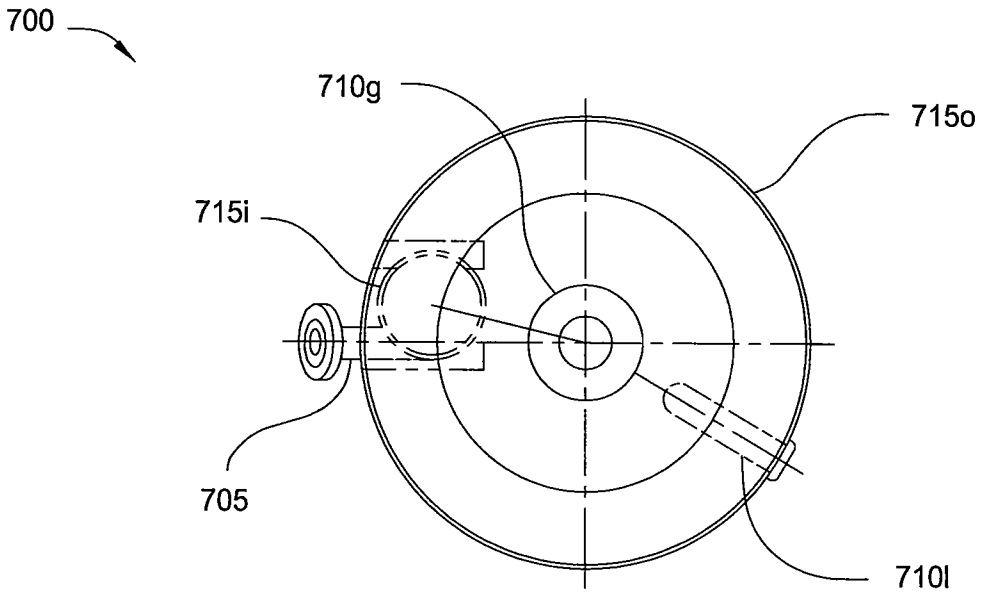
FIG. 7A is a plan view of the separator.

FIG. 7 is a side view of a centrifugal separator 700, according to another embodiment of the present invention. FIG. 7A is a plan view of the separator 700. The separator 700 may include an inlet 705, a gas outlet 710*g*, a liquid outlet 710*l*, an outer tubular 715*o*, an inner tubular 715*i*, a support 720, one or more liquid film breakers 725*i*, longitudinal caps 730, 735, a drain 740, and a mist extractor 745. Even though only the second inlet portion 705 is shown, the inlet 705 may further include the first inlet portion 5*a* and the nozzle 5*b*. The separator 700 may be similar to the separators 1, 200 in basic form and operation so only differences are discussed below. The separator 700 may be used in any of the systems 300-600, discussed above, instead of the separator 200.

The inner tubular 715*i* may be eccentrically disposed within the outer tubular 715*o*. The inner tubular 715*i* may be radially disposed proximate to or on the inner surface of the outer tubular 715. A center of the inner tubular 715*i* may also be longitudinally offset relative to a center of the outer tubular so that the inner tubular 715*i* is substantially disposed within an upper half of the outer tubular 715*o*. The liquid outlet 710*l* may also be eccentrically disposed within the outer tubular 715*o* and may be radially distal from the inner tubular 715*i*. A diameter of the inner tubular 15*i* may range from one-tenth to two-fifths of a diameter of the outer tubular 15*o*. The inner tubular 15*i* may extend a partial length of the outer tubular 15*o*, such as one-quarter to three-fifths the length of the outer tubular 15*o*. The diameter of the outer tubular 15*o* may range from one-quarter to three-fifths the length of the outer tubular 15*o*. The inner tubular diameter may be equal or substantially equal to the second diameter.

The separator 700 may be sized and controlled to maintain a liquid level in the outer tubular bore. The liquid level may be maintained between a minimum, such as at the upper end of the cap 730 and a maximum, such as proximately below a junction of the inlet 705 and the inner tubular 715*i*.

While the foregoing is directed to embodiments of the present invention, other and further embodiments of the invention may be devised without departing from the basic scope thereof, and the scope thereof is determined by the claims that follow.

The invention claimed is:

1. A separator, comprising:

an outer tubular having ends sealed from the environment;

an inner tubular:

disposed within the outer tubular, having ends in fluid communication with a bore of the outer tubular, and attached to the outer tubular;

an inlet:

disposed through a wall of the outer tubular, in fluid communication with a bore of the inner tubular, and tangentially attached to the inner tubular so that fluid flow from the inlet to the inner tubular is centrifugally accelerated within the inner tubular;

a gas outlet in fluid communication with the outer tubular bore; and a liquid outlet in fluid communication with the outer tubular bore.

2. The separator of claim 1, wherein longitudinal axes of the tubulars are vertically oriented.

3. The separator of claim 2, wherein the inlet comprises a first portion tangentially attached to the inner tubular and inclined at an angle relative to the horizontal substantially less than ninety degrees.

4. The separator of claim 3, wherein the angle is between ten to forty-five degrees.

5. The separator of claim 3, wherein the inlet further comprises:

a nozzle connected to the first portion; and a second portion connected to the nozzle and having a second diameter substantially greater than a first diameter of the first portion.

6. The separator of claim 5, wherein the inlet further comprises a horizontal third portion connected to the second portion and having the second diameter substantially greater than the first portion.

7. The separator of claim 2, further comprising a mist extractor disposed at or near an upper end of the outer tubular.

8. The separator of claim 2, further comprising a vortex breaker disposed on a lower end of the inner tubular.

9. The separator of claim 2, further comprising:

a first annular member disposed at or near an upper end of the outer tubular, extending inward from an inner surface of the outer tubular, and configured to prevent a liquid film on the inner surface of the outer tubular from being drawn above the first annular member; and a second annular member disposed at or near an upper end of the inner tubular extending inward from an inner surface of the inner tubular, and configured to prevent a liquid film on the inner surface of the inner tubular from being drawn above the second annular member.

10. The separator of claim 1, wherein a diameter of the outer tubular is one-sixth to two-thirds of a length of the outer tubular.

11. The separator of claim 10, wherein a diameter of the outer tubular is one-fourth to two-fifths of the length of the outer tubular.

12. The separator of claim 1, wherein the inner tubular extends a substantial length of a length of the outer tubular.

13. The separator of claim 1, wherein a diameter of the inner tubular is one-sixth to two-thirds a diameter of the outer tubular.

14. The separator of claim 13, wherein the diameter of the inner tubular is one-fourth to two-fifths of the diameter of the outer tubular.

15. The separator of claim 1, further comprising a liquid flow meter in fluid communication with the liquid outlet and a gas flow meter in fluid communication with the gas outlet.

16. The separator of claim 15, further comprising a water cut meter in fluid communication with the liquid outlet.

17. The separator of claim 15, further comprising a skid, wherein the outer tubular and the flow meters are mounted on the skid.

18. The separator of claim 1, wherein the inner tubular is centrally disposed within the outer tubular.

19. The separator of claim 1, wherein the inner tubular is eccentrically disposed within the outer tubular.

20. A method of testing a wellbore using the separator of claim 1, comprising:

separating a production stream from the wellbore into a gas portion and a liquid portion using the separator; and measuring a flow rate of the gas portion; and measuring a flow rate of the liquid portion.

21. The method of claim 20, further comprising maintaining a liquid level in an annulus defined between the tubulars.

22. The method of claim 20, wherein:

the production stream comprises crude oil, natural gas, and water, and the method further comprises measuring water cut of the liquid portion.

23. The method of claim 20, further comprising combining the gas and liquid portions.

24. A method for drilling a wellbore using the separator of claim 1, comprising acts of:

injecting drilling fluid through a tubular string disposed in the wellbore, the tubular string comprising a drill bit disposed on a bottom thereof, wherein:

the drilling fluid is injected at the surface, the drilling fluid comprises:

a gas; and a liquid;

the drilling fluid exits the drill bit and carries cuttings from the drill bit, and the drilling fluid and cuttings (returns) flow to the surface via an annulus defined by an outer surface of the tubular string and an inner surface of the wellbore;

rotating the drill bit; and separating at least the gas from the returns using the separator.

25. The method of claim 24, wherein a liquid volume fraction of the drilling fluid at standard temperature and pressure is less than or equal to 0.025 and greater than or equal to 0.01.

26. The method of claim 24, wherein the drill bit is located in a nonproductive formation.

27. The method of claim 24, further comprising while drilling the wellbore:

measuring a first annulus pressure (FAP) using a pressure sensor attached to a casing string hung from a wellhead of the wellbore; and controlling a second annulus pressure (SAP) exerted on a formation exposed to the annulus.

28. The method of claim 27, further comprising transmitting the FAP measurement to a surface of the wellbore using a high-bandwidth medium.

29. The method of claim 27, further comprising calculating the SAP using the FAP measurement.

30. The method of claim 27, further comprising, while drilling:

measuring a bottom hole pressure (BHP); and wirelessly transmitting the BHP measurement to the casing string or to the surface of the wellbore.

31. The method of claim 27, wherein the SAP is controlled to be proximate to a pore pressure of the formation.

32. A method for producing a wellbore using high and low pressure separators, wherein at least one of the high and low separators is the separator of claim 1, of the method comprising:

separating a production stream from the wellbore into a gas portion and a liquid portion using the high pressure separator;

discharging the liquid portion into the low pressure separator; and separating the liquid portion into a second gas portion and a second liquid portion using the low pressure separator.

* * * * *

UNITED STATES PATENT AND TRADEMARK OFFICE

CERTIFICATE OF CORRECTION

PATENT NO. : 9,010,440 B2
APPLICATION NO. : 12/369043
DATED : April 21, 2015
INVENTOR(S) : Rodger et al.

It is certified that error appears in the above-identified patent and that said Letters Patent is hereby corrected as shown below:

In the Claims:

Column 16, Claim 32, Line 21, please delete "of".

Signed and Sealed this
Twenty-second Day of September, 2015

Michelle K. Lee

Michelle K. Lee
*Director of the United States Patent and Trademark Office*